US009653889B2

(12) United States Patent
Sung et al.

(10) Patent No.: US 9,653,889 B2
(45) Date of Patent: May 16, 2017

(54) IONIZER

(71) Applicant: LG ELECTRONICS INC., Seoul (KR)

(72) Inventors: Bong Jo Sung, Seoul (KR); Jae Soo Jang, Seoul (KR); Kyung Soo Yoon, Seoul (KR); Il Na Son, Seoul (KR); Jung Geun Oh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/431,985

(22) PCT Filed: Sep. 23, 2013

(86) PCT No.: PCT/KR2013/008472
§ 371 (c)(1),
(2) Date: Mar. 27, 2015

(87) PCT Pub. No.: WO2014/051294
PCT Pub. Date: Apr. 3, 2014

(65) Prior Publication Data

US 2015/0255962 A1 Sep. 10, 2015

(30) Foreign Application Priority Data

Sep. 28, 2012 (KR) ..... 10-2012-0109095

(51) Int. Cl.
*F24F 3/16* (2006.01)
*H01T 23/00* (2006.01)
*F24F 1/00* (2011.01)

(52) U.S. Cl.
CPC ..... *H01T 23/00* (2013.01); *F24F 3/16* (2013.01); *F24F 2001/004* (2013.01); *F24F 2001/0048* (2013.01); *F24F 2003/1682* (2013.01)

(58) Field of Classification Search
CPC ..... A61L 9/22
USPC ..... 422/22
See application file for complete search history.

(56) References Cited

U.S. PATENT DOCUMENTS

2005/0198853 A1* 9/2005 Cafaro ..... A45D 20/10 34/96
2010/0039746 A1 2/2010 Shaw

FOREIGN PATENT DOCUMENTS

KR 20-0337085 Y1 12/2003
KR 10-2005-0087666 A 8/2005
KR 10-2005-0097602 A 10/2005
KR 20-2009-0006291 U 6/2009

OTHER PUBLICATIONS

International Search Report dated Jan. 22, 2014 issued in Application No. PCT/KR2013/008472 (full English text).

* cited by examiner

*Primary Examiner* — Sean E Conley
(74) *Attorney, Agent, or Firm* — KED & Associates, LLP

(57) ABSTRACT

The present invention relates to an ionizer mounted to an air outlet of an air conditioner, and includes an ion generating unit for generating ions, and an ion visualizing unit mounted to an air outlet of an air conditioner for notifying whether the ion generating unit generates the ions or not, the ion visualizing unit having the ion generating unit mounted thereto, thereby permitting a user to notice whether the ionizer is mounted or not easily, and to express whether ions are generated or not and intensity of the ion generation.

4 Claims, 5 Drawing Sheets

IONIZER

CROSS-REFERENCE TO RELATED PATENT APPLICATIONS

This application is a U.S. National Stage Application under 35 U.S.C. §371 of PCT Application No. PCT/KR2013/008472, filed Sep. 23, 2013, which claims priority to Korean Patent Application No. 10-2012-0109095, filed Sep. 28, 2012, whose entire disclosures are hereby incorporated by reference.

TECHNICAL FIELD

The present invention relates to an ionizer mounted to an air outlet of an air conditioner.

BACKGROUND ART

In general, as environmental pollution becomes the worse, people having different respiratory disease or showing allergy reaction caused by polluted air increases the more. Consequently, various attempts, such as generation of anions, have been made for cleaning the polluted air to improve a quality of the air.

The anion, a molecule of oxygen, nitrogen, or so on having a negative charge, is very beneficial for a human body, and effective for removal of dust and odor.

The anion may be generated by an ionizer 10 fabricated as a small sized module, and the ionizer may be used mounted to, and used in, different types of air conditioners, such as air purifiers, air cleaners, ventilators, air coolers, air heaters, and so on.

Referring to FIG. 1, for an example, the ionizer 10 may be mounted to a wall mounting type air conditioner 20 in a small sized module to generate at least one of cation or anion, and, as another example, as shown in FIG. 2, the ionizer 10 may be mounted to a stand type air conditioner 30 as a small sized module to generate at least one of the cation or the anion.

However, since the ionizer 10 is mounted to the air conditioner as a small sized module, the ionizer 10 mounted to the air conditioner has problems in that it is difficult for a user to recognize whether the small sized ionizer module 10 is mounted to the air conditioner or not easily, and whether the ionizer 10 generates the ions normally or not, exactly.

DISCLOSURE OF INVENTION

Technical Problem

To solve the problems, an object of the present invention is to provide an ionizer which can visualize the ionizer mounted to an air outlet of an air conditioner for a user to know easily, and the user can recognize whether the ion is being generated or not and an intensity of ion generation, exactly.

Solution to Problem

To achieve these objects and other advantages, an ionizer includes an ion generating unit for generating ions, and an ion visualizing unit mounted to an air outlet of an air conditioner for notifying whether the ion generating unit generates the ions or not, the ion visualizing unit having the ion generating unit mounted thereto.

The ion visualizing unit may include a housing having the ion generating unit mounted therein and at least one hole formed therein for discharging the ions the ion generating unit generates.

The ion generating unit may be mounted to face a direction perpendicular to an air discharge direction of the air outlet.

The housing may have a printed circuit board with a controller mounted thereto for controlling the turned on/off operation of the ion generating unit mounted thereto.

The housing may include a side plate having at least one hole facing the air outlet, and a front plate facing an outside of the air conditioner perpendicular to the side plate.

The ion visualizing unit may further include a light element mounted to the housing for notifying whether the ions are generated or not.

The light element may be mounted to face a direction parallel with the air discharging direction of the air outlet.

The light element may be turned from a turned off state to a turned on state when the ion generating unit generates the ions.

The light element may be mounted in plural in number, and a number of the light elements which are turned to the turned on state may vary with intensity of ion generation of the ion generating unit.

The light element may have brightness or a color varied with intensity of ion generation of the ion generating unit.

Advantageous Effects of Invention

The ionizer of the present invention mounted to the air outlet of the air conditioner includes an ion generating unit for generating ions, and an ion visualizing unit for notifying whether the ions are generated or not, and has an advantage in that the user can notice whether the ionizer is mounted or not, easily.

And, whether the ions are generated or not, or the intensity of ion generation can be known exactly with a turn on/off state, brightness, or a color of the light elements.

BEST MODE FOR CARRYING OUT THE INVENTION

Hereinafter, preferred embodiments of the present invention will be described with reference to the attached drawings, in detail.

Figure 1:
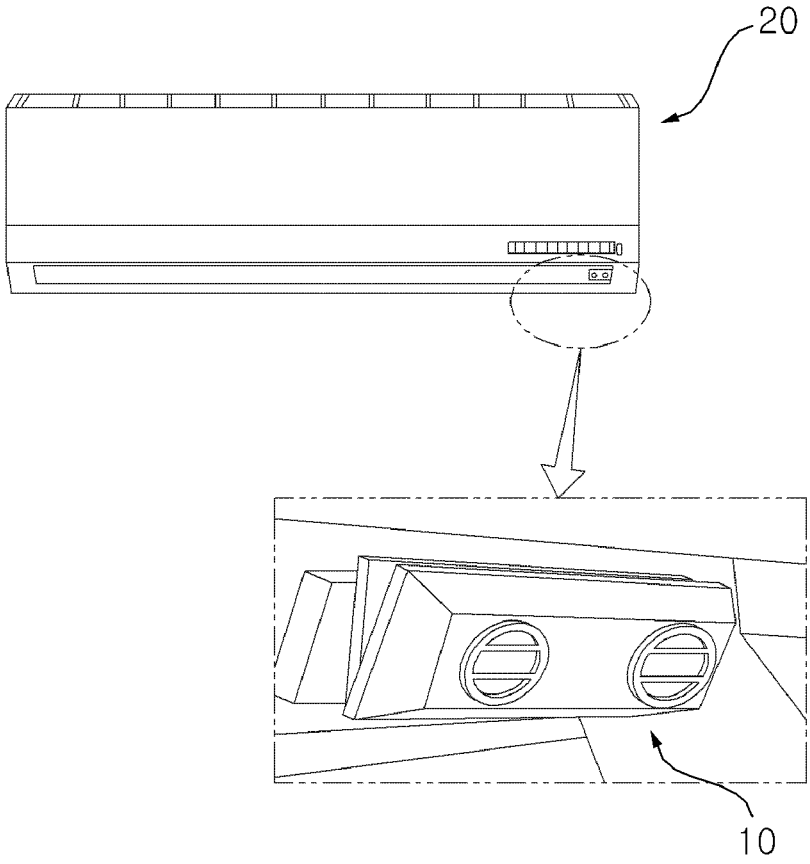
FIG. 1 illustrates a perspective view showing an example of an ionizer mounted to a wall mounting type air conditioner.
Figure 2:
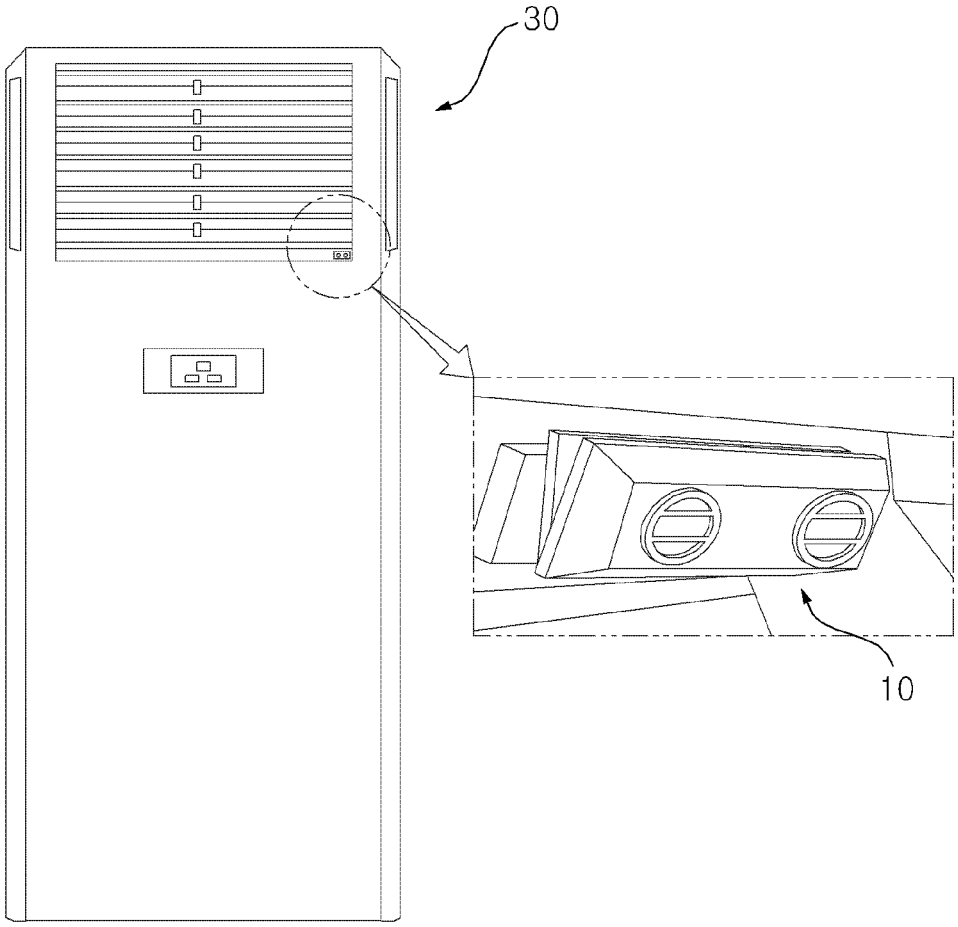
FIG. 2 illustrates a perspective view showing an example of an ionizer mounted to a stand mounting type air conditioner.
Figure 3:
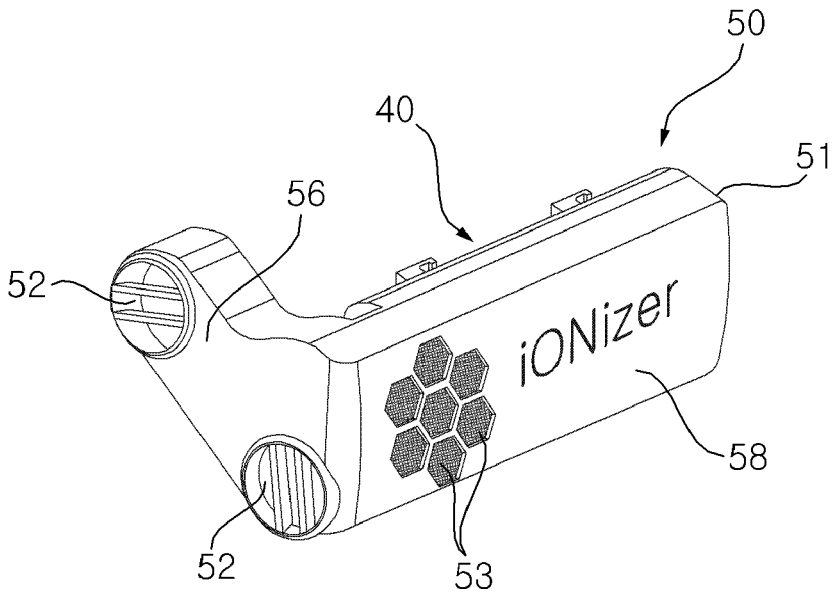
FIG. 3 illustrates a perspective view of an ionizer in accordance with an embodiment of the present invention.
Figure 4:
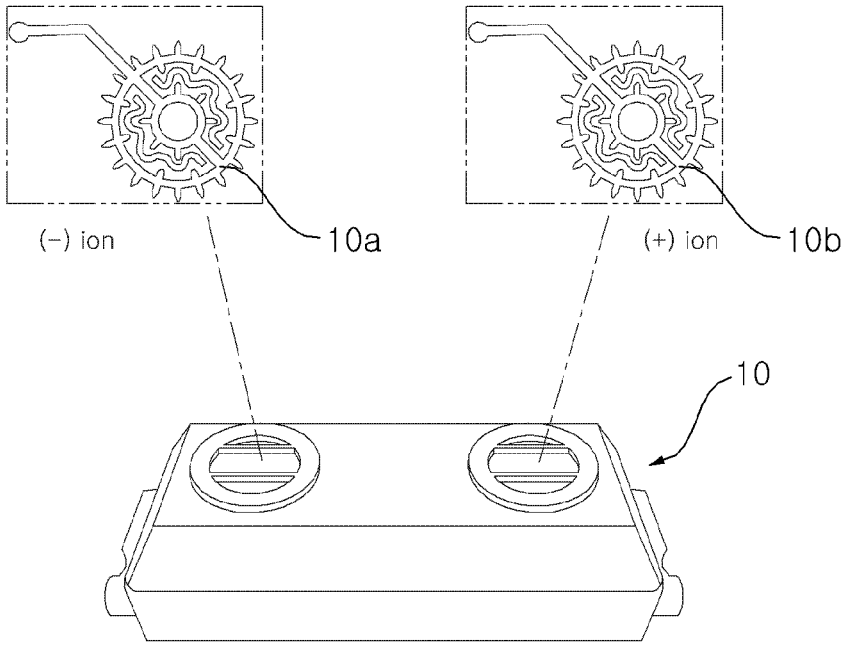
FIG. 4 illustrates a perspective view of a modular ionizer in accordance with an embodiment of the present invention.

The ionizer of the present invention may be mounted to an air outlet 22 of an air conditioner 20. As shown in FIGS. 3 and 4, the ionizer may include an ion generating unit 10 for generating ions, and an ion visualizing unit 50 for notifying whether the ion generating unit 10 generates the ions or not.

Referring to FIG. 4, the ion generating unit 10 may include an anion electrode 10*a* for generating anions (−), and a cation electrode 10*b* for generating cations (+). The ion generating unit 10 may have the anion electrode 10*a* and the cation electrode 10*b* fabricated into one module. The ion generating unit 10 may be mounted to an ion visualizing unit 50. The ion generating unit 10 may be mounted in the ion visualizing unit 50. The ions from the ion generating unit 10 may be discharged to an outside of the ion visualizing unit 50 unit passed through the ion visualizing unit 50. The ion generating unit 10 may be mounted to the ion visualizing unit 50 perpendicular to an air discharge direction of the air conditioner.

The ion visualizing unit 50 may be mounted to the air outlet 22 of the air conditioner 20. The ion visualizing unit 50 may include a housing 51 for housing the ion generating unit 10 therein. The ion visualizing unit 50 may include a light element 53 mounted to the housing 51 for notifying whether the ion generating unit 10 generates the ions or not.

The housing 51 may form an exterior appearance of the ionizer. As shown in FIG. 3, the housing 51 may have a "¬" shape. The housing may have at least one hole 52 formed therein for discharging the ions generated by the ion generating unit 10. The housing 51 may include a side plate 56 facing the air outlet 22, and a front plate 58 mounted perpendicular to the side plate 56 to face an outside of the air conditioner. The side plate 56 of the housing 51 may have at least one hole 52 formed therein. The ion generating unit 10 may be built in the housing 51, for discharging the anions and the cations generated by the ion generating unit 10 through the at least one hole 52 formed in the housing 51 to an outside of the housing 51. The housing 51 may have two holes 52 formed therein. In this case, the anions may be discharged from the ion generating unit 10 through one of the two holes 52, and the cations may be discharged from the ion generating unit 10 through the other one of the two holes 52. The ion generating unit 10 may be mounted in the housing 51 to face a direction perpendicular to the air discharge direction of the air conditioner, the anions and the cations from the ion generating unit 10 may pass through the air outlet 22 of the air conditioner 20 via the holes 52 in the housing 51, and may be carried away by the air being discharged to the outside of the air conditioner 20 through the air outlet 22 of the air conditioner 20. Mounted to the housing 51, there may be a PCB (Printed Circuit Board) 40 with a controller (Not shown) mounted thereto for controlling turning on/off of the ion generating unit 10.

The light element 53 may be mounted to the housing 51 to face a direction parallel to the air discharge direction of the air conditioner. The light element 53 may have a light source, such as an LED (Light Emitting Device). The light element 53 may direct a light in a direction the front plate 58 of the housing 51 faces. The light element 53 may be mounted to the front plate 58 of the housing 51. The light element 53 may be controlled by the controller. The light element 53 may be turned from a turned off state to a turned on state when the ion generating unit 10 generates the ions. The light element 53 may vary brightness or a color thereof with intensity of ion generation of the ion generating unit 10. The light element 53 may have brightness thereof increasing gradually if the ion generating unit 10 generates the ions, after the ion generating unit 10 is changed from the turned off state to the turned on state, or if the intensity of the ion generation increases gradually in proportion thereto. The light element 53 may vary a color thereof from a blue color to a red color gradually if the ion generating unit 10 generates the ions, after the ion generating unit 10 is changed from the turned off state to the turned on state, or if the intensity of the ion generation increases gradually. A plurality of the light elements 53 may be mounted to the front plate 58 of the housing 51. The light elements 53 may have a number of the light elements 53 changed to a turned on state varied with the intensity of the ion generation of the ion generating unit 10. Least number of the light elements 53 may be turned on at the time the ion generating unit 10 generates the ions, and, if the intensity of the ion generation increases gradually, the number of turned on light elements 53 may increase.

Figure 5:
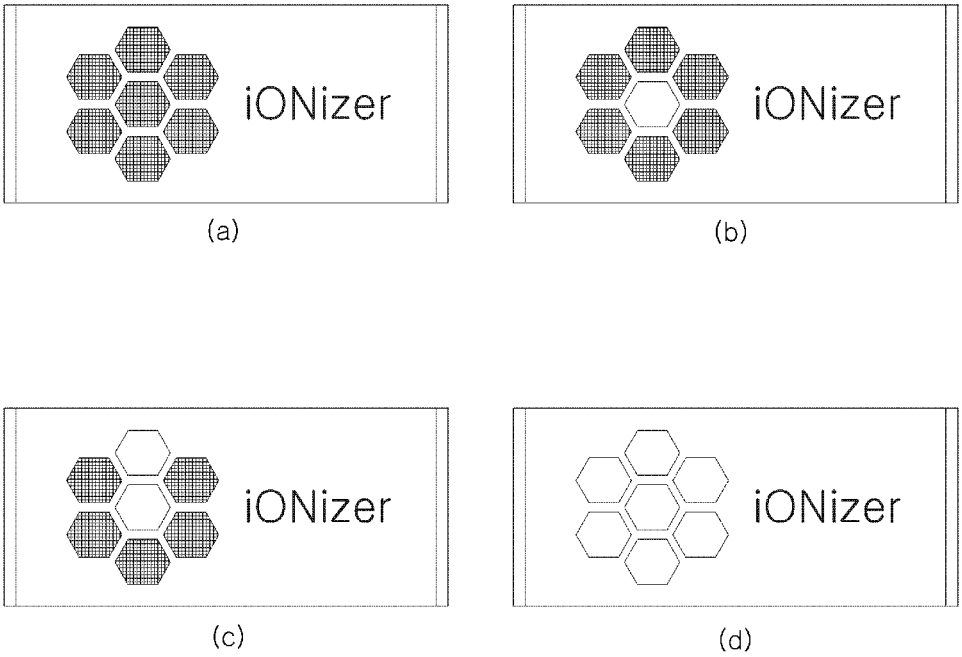
FIGS. 5A~5D illustrate schematic views showing LEDS (Light Emitting Devices) mounted to an ion visualizing unit controlled to be turned on/off in accordance with an embodiment of the present invention.

Referring to FIG. 5, in a case the front plate 58 of the housing 51 has seven light elements mounted thereto, if the ion generating unit 10 is in a turned off state, all of the seven light elements may be in the turned off state as shown in FIG. 5A, and, if the ion generating unit 10 is turned from the turned off state to a turned on state, only one of the seven light elements may be in the turned on state as shown in FIG. 5B. If the intensity of ion generation of the ion generating unit 10 increases after the ion generating unit 10 is operated normally, a turned on number of the seven light elements may increase as shown in FIG. 5C, and, if the intensity of ion generation of the ion generating unit 10 is a highest, all of the seven light elements may be turned on.

Figure 6:
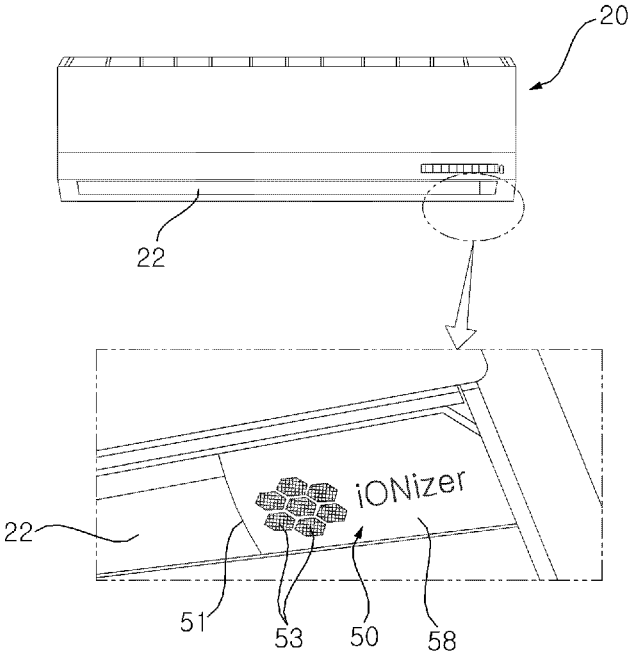
FIG. 6 illustrates a perspective view showing an example of an ionizer mounted to a wall mounting type air conditioner in accordance with an embodiment of the present invention.

Referring to FIG. 6, upon noticing the ion visualizing unit 50 mounted to the air outlet 22 of the air conditioner 20, the user can determine whether the ionizer is mounted or not, easily. The user can determine the turned on/off state of the light elements of the ion visualizing unit 50 mounted to the air outlet 22 of the air conditioner 20 even far therefrom, and can determine whether the ion generating unit 10 exists or not, whether the ion generating unit 10 generates the ions or not, and the intensity of ion generation of the ion generating unit 10 according to the turned on/off state, the brightness, and the color of the light elements 53, exactly.

Figure 7:
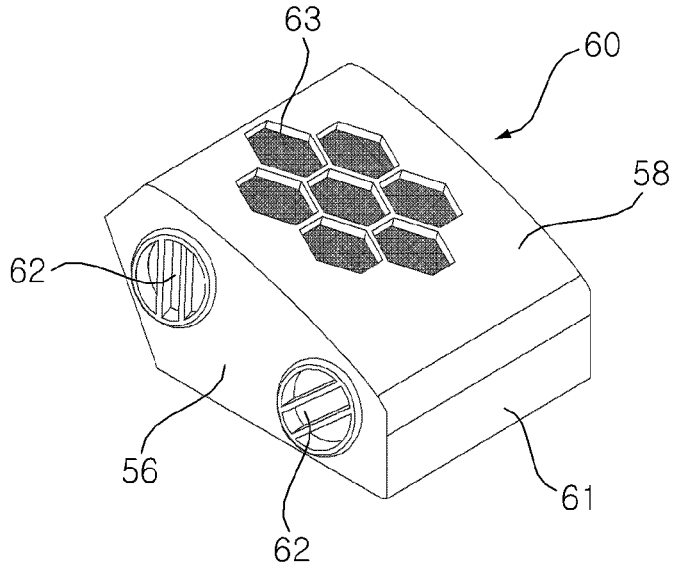
FIG. 7 illustrates a perspective view of an ionizer in accordance with another preferred embodiment of the present invention.

Referring to FIG. 7, the ion visualizing unit 50 may be fabricated, not in the "¬" shape, but in other shapes of an ion visualizing unit 60. As an example, the ion visualizing unit 60 may be fabricated in a variety of shapes including a housing 61 for mounting the ion generating unit therein, holes 62 for discharging ions generated by the ion generating unit 10 to an outside of the ion generating unit 10, and light elements 63 for notifying whether the ions are generated or not.

Thus, the preferred embodiments of the present invention described thus are disclosures for illustrative purposes, and various modifications, changes, and addition will be possible without departing from the spirit or scope of the invention by those skilled in this field of art.

The invention claimed is:

1. An air conditioner comprising:

a case having an air outlet through which air is discharged;

an ion generating unit to generate ions; and an ion visualizing unit mounted to the air outlet that notifies intensity of ion generation of the ion generating unit, the ion visualizing unit having the ion generating unit mounted thereto, wherein the ion visualizing unit includes:

a housing having the ion generating unit mounted therein; and a plurality of light elements mounted to the housing in a prescribed configuration that notifies intensity of ion generation of the ion generating unit, wherein a number of the plurality of light elements which are turned on or off gradually increases or decreases, respectively, based on the intensity of ion generation, wherein the plurality of light elements is configured so that more than one of the plurality of light elements are illuminated simultaneously in order to notify a user that the intensity of ion generation is higher than a lowest turned-on ion generation intensity, and wherein the housing includes:

a side plate having at least one hole facing a direction perpendicular to an air discharge direction of the air outlet for the generated ion to flow with the air discharged through the air outlet; and a front plate mounted perpendicular to the side plate to face a direction parallel with the air discharging direction of the air outlet, and wherein the plurality of light elements is mounted to the front plate and the plurality of light elements directs light in a direction the front plate faces.

2. The air conditioner as claimed in claim 1, wherein the housing has a printed circuit board with a controller mounted thereto for controlling a turned on/off operation of the ion generating unit mounted thereto.

3. The air conditioner as claimed in claim 1, wherein at least one of the light elements is turned from a turned off state to a turned on state when the ion generating unit generates the ions.

4. The air conditioner as claimed in claim 1, wherein the plurality of light elements has at least one of a brightness or a color varied with intensity of ion generation of the ion generating unit.

* * * * *